United States Patent [19]

Velarde

[11] 4,001,926

[45] Jan. 11, 1977

[54] DOUBLE CLIPPER, SINGLE PISTON OPERATED DEVICE

[75] Inventor: Clyde R. Velarde, Raleigh, N.C.

[73] Assignee: Rheem Manufacturing Company, New York, N.Y.

[22] Filed: Mar. 18, 1976

[21] Appl. No.: 668,148

Related U.S. Application Data

[63] Continuation-in-part of Ser. No. 565,581, April 7, 1975.

[52] U.S. Cl. ..... 29/243.56

[51] Int. Cl.[2] ..... B23P 11/00

[58] Field of Search ..... 29/243.56, 243.52; 227/108

[56] References Cited

UNITED STATES PATENTS

| | | | |
|---|---|---|---|
| 2,899,679 | 8/1959 | Allen | 227/108 |
| 3,940,841 | 3/1976 | Velarde et al. | 29/243.56 |

*Primary Examiner*—James L. Jones, Jr.

*Attorney, Agent, or Firm*—Allegretti, Newitt, Witcoff & McAndrews

[57] ABSTRACT

A single piston clipper device includes a center punch and spaced linkage arms all responsive to the movement of the drive rod of the single piston. The linkage arms operate pivotal gates that gather material to be clipped. A die in one of the gates is simultaneously positioned for cooperation with the punch. A lost motion cam track insures closing of the gates prior to fastening of the clip about the gathered material between the gates. A gathering bar responsive to rotational movement of the gates assists in the gathering of material prior to attachment of the clip around the material. Two punches and associated gates may be driven simultaneously by the same piston. A knife is provided to sever the clipped material.

12 Claims, 8 Drawing Figures

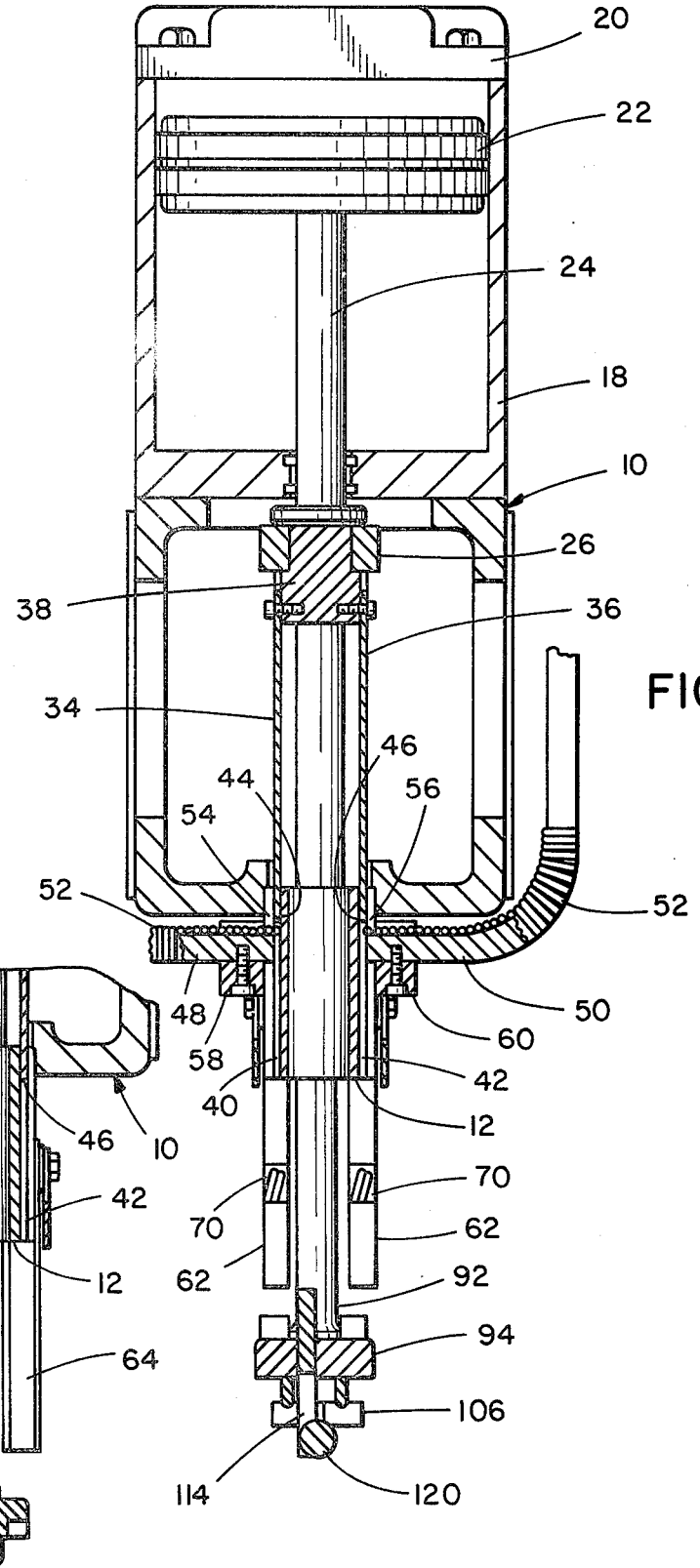
FIG. 5
FIG. 6
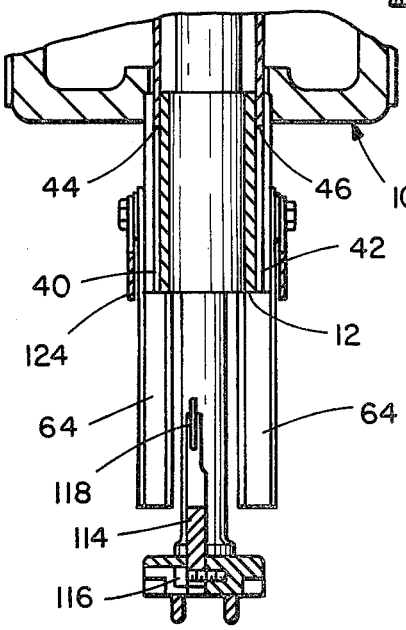

DOUBLE CLIPPER, SINGLE PISTON OPERATED DEVICE

CROSS REFERENCE TO RELATED APPLICATION

This is a continuation-in-part of U.S. application Ser. No. 565,581 filed Apr. 7, 1975 which is incorporated herewith by reference. A related patent is U.S. Pat. No. 3,940,841 issued Mar. 2, 1976.

BACKGROUND OF THE INVENTION

This invention relates to an improved single piston or single drive operated clip attachment device.

Use of a single drive mechanism to effect a clip attachment operation has been suggested in various applications and patents. For example, application Ser. No. 550,550 filed Feb. 18, 1975 disclosed a single piston operated clip attachment device wherein a punch is brought into cooperation with a die subsequent to formation of a clip channel by linkage arms attached to the punch drive. Such a mechanism has been found to be especially useful for attachment of clips about a rather large mass.

With the aforementioned device, however, material which is gathered must be inserted through a passage in a mounting plate prior to attachment of a clip. Thus, access to the clipper is partially limited. The presently described apparatus is an improved single piston operated clipper which automatically gathers the material to be clipped prior to attachment of the clip.

SUMMARY OF THE INVENTION

In a principal aspect, the present invention comprises an improve clip attachment device including a mounting frame with drive means on the frame. The drive means includes a drive shaft for driving a punch and attached drive rods. The punch is positioned to engage a clip. The drive rods are positioned to drive pivoting gates from an open position to a closed, material gathered position. One of the gates includes a die member. The gates are closed prior to driving the clip into engagement with the die. A supplemental gathering linkage responsive to movement of the pivoting gates is provided to assist gathering the material between the gates prior to attachment of a clip.

It is thus an object of the present invention to provie an improved single drive operated, clip attachment device.

It is a further object of the present invention to provide an improved clip attachment device wherein opposed gate members operate to gather the material to be clipped, one of the gate members including a die cooperative with a punch for clip attachment.

Still a further object of the present invention is to provide an improved single drive clipper device which provides sequential gathering and positioning of the material to be clipped prior to attachment of the clip by means of a drive punch.

Another object of the present invention is to provide a single drive means clip drive wherein a die cooperative with a punch is positively positioned in the path of the punch and retained in that path while the punch engages the clip and drives the clip into engagement with a die.

A further object of the present invention is to provide an improved clip attachment device of simple construction that can be easily repaired or serviced.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 5 is a cross-sectional view of the device shown in FIG. 4 taken along the line 5—5;

FIG. 6 is a partial cross section of the clipper of FIG. 4 taken along the line 6—6;

DESCRIPTION OF THE PREFERRED EMBODIMENT

Figure 1:
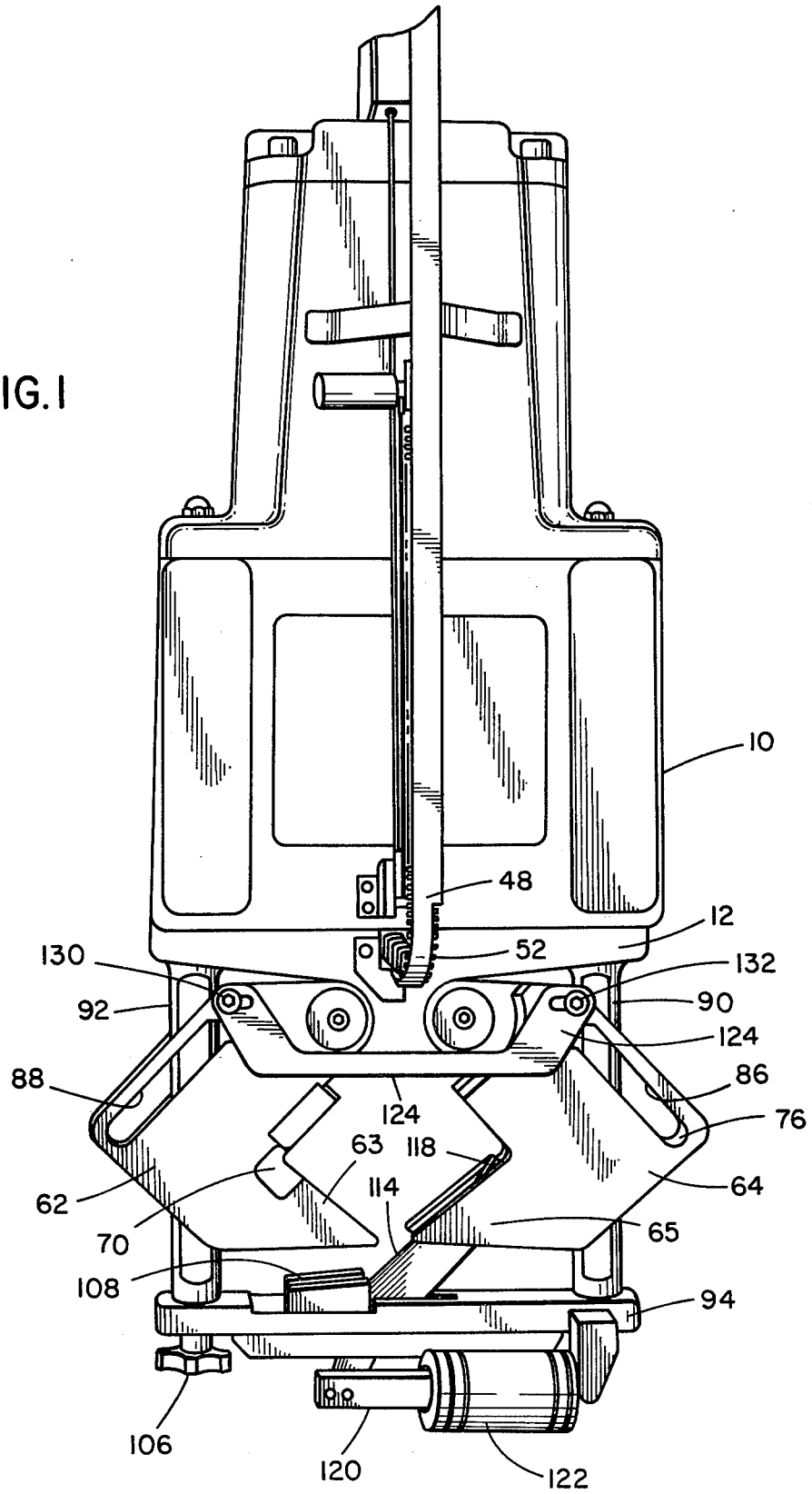
FIG. 1 is a front perspective view of the improved clipping device of the present invention.
Figure 2:
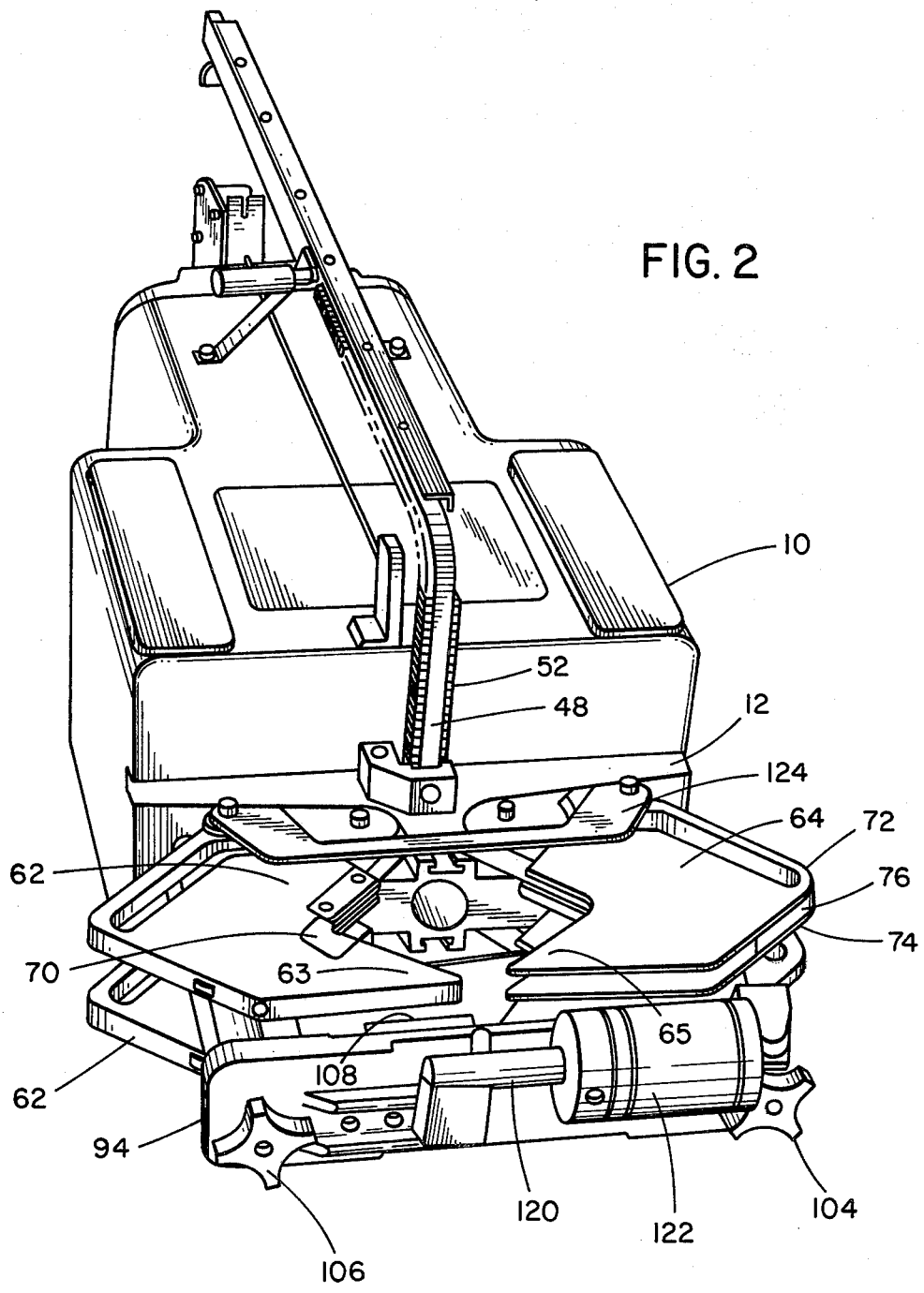
FIG. 2 is a bottom perspective view of the improved device shown in FIG. 1.
Figure 3:
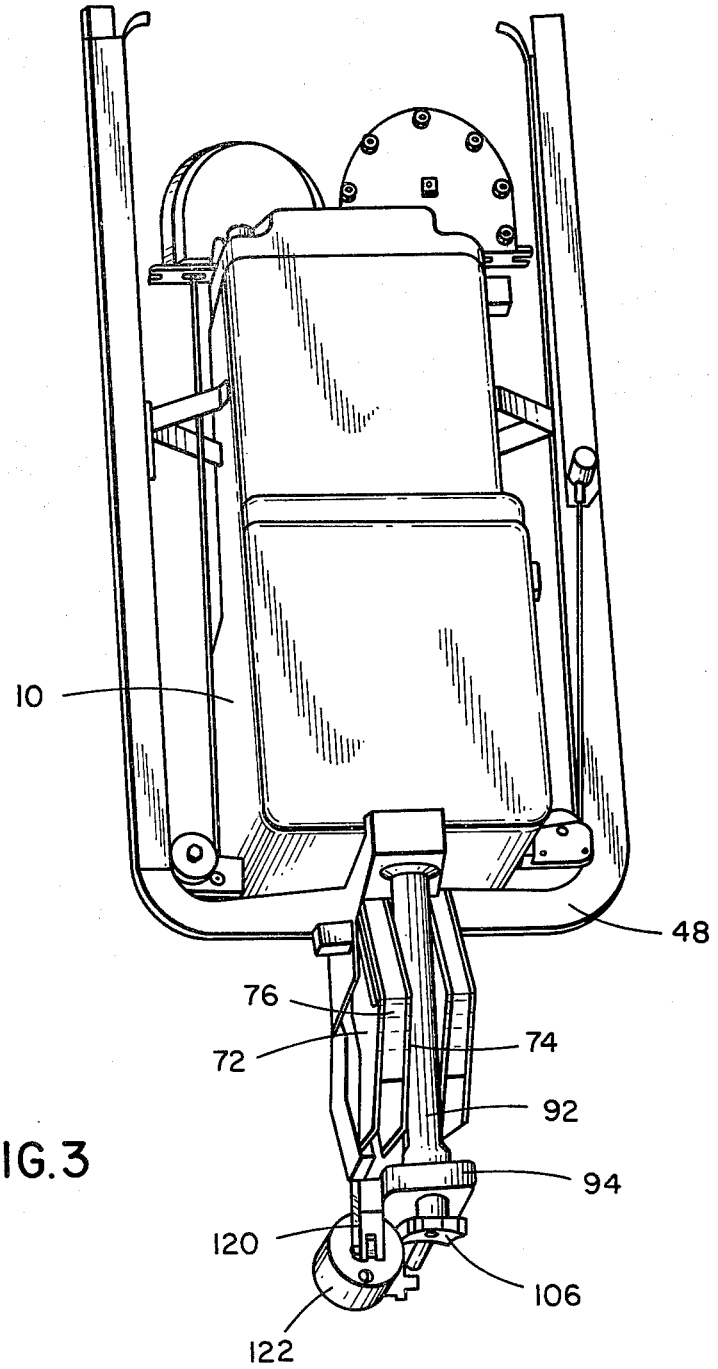
FIG. 3 is a side perspective view of the improved clipping device shown in FIG. 1.
Figure 4:
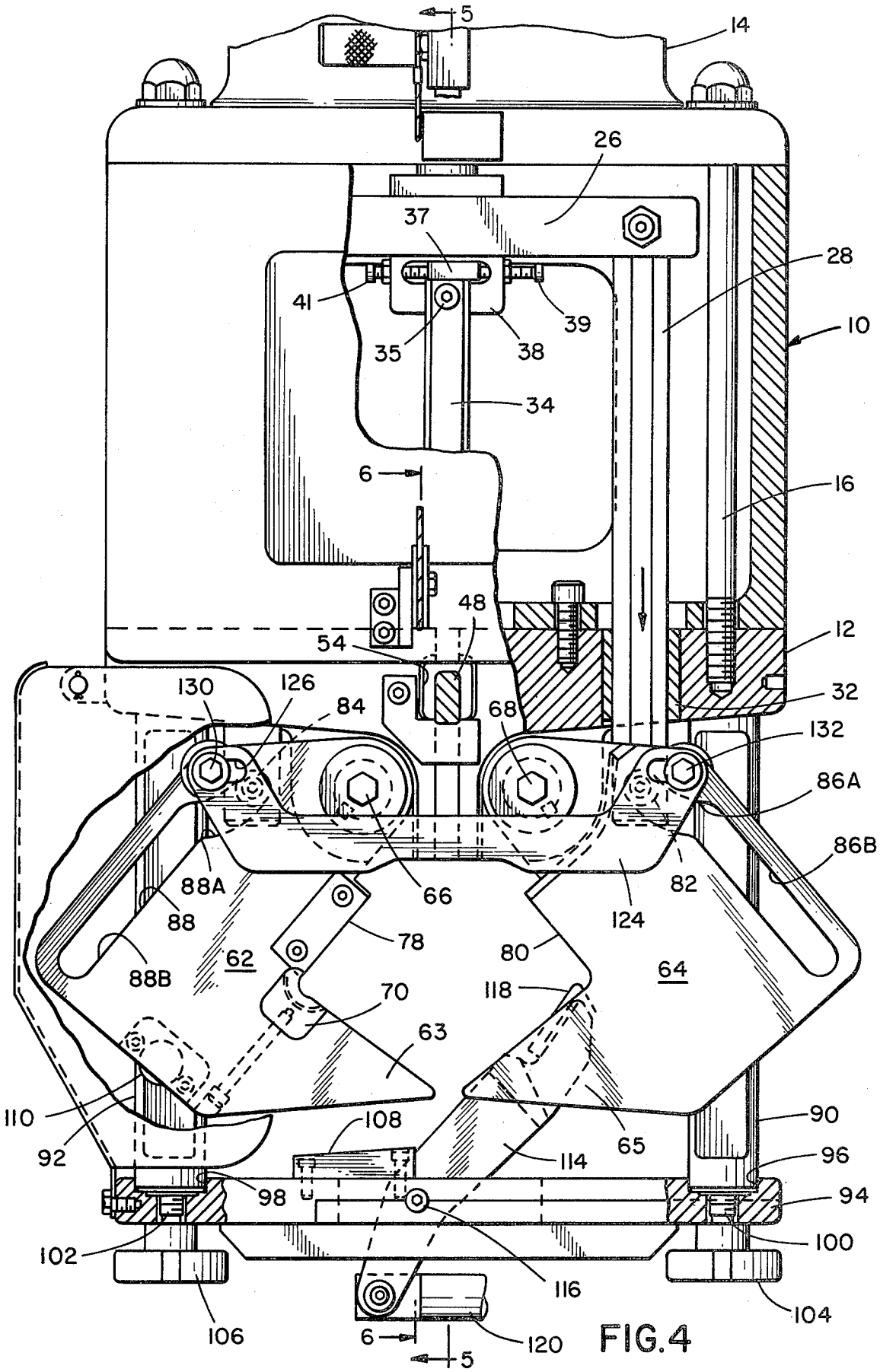
FIG. 4 is a front elevation of the clipping device shown in FIG. 1 partially sectioned.
Figure 7:
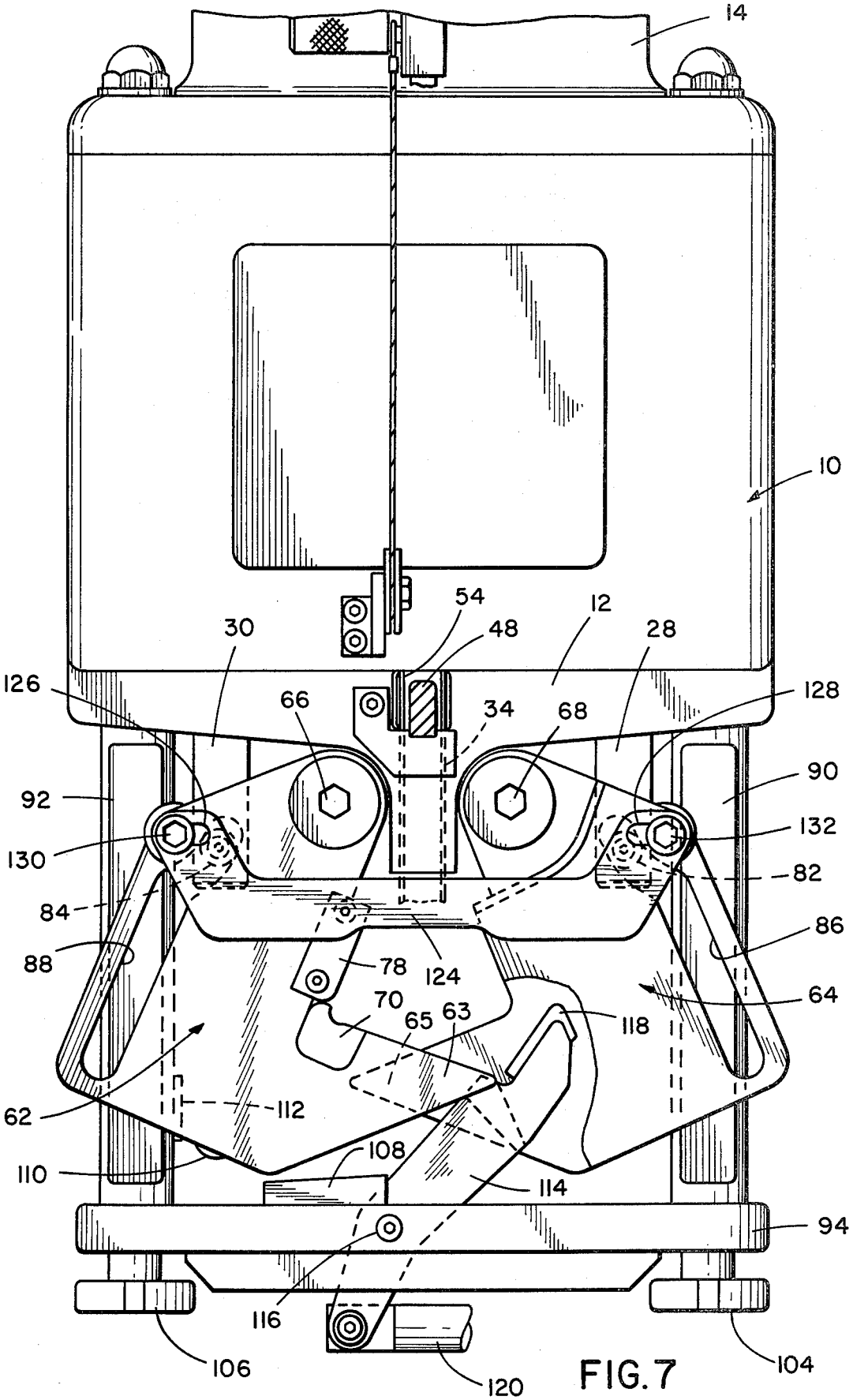
FIG. 7 is a front elevation of the clipper device wherein the gates are partially closed.
Figure 8:
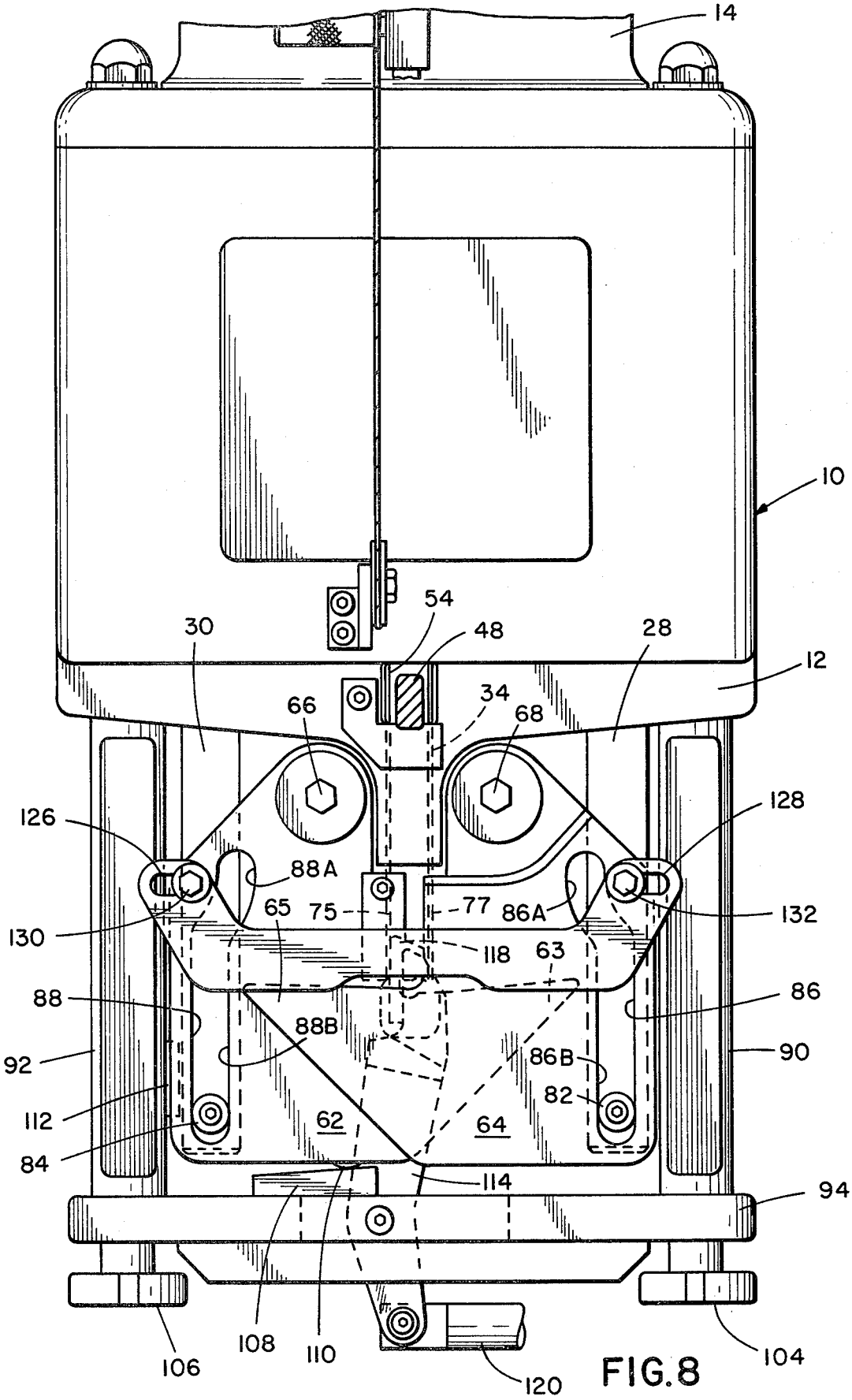
FIG. 8 is a front elevation illustrating full closure of the gates of the clipper device.

FIGS. 1 through 3 of the drawing illustrate the general overal configuration of the improved clipper device. FIGS. 4 through 6 illustrate in greater detail the mechanical construction of the clipper device. FIGS. 7 and 8 illustrate the operative movement of the various parts of the clipper device.

Referring to the figures, a main housing or frame 10 is provided. This housing or frame 10 is maintained generally in a fixed position at a work station, for example, in a sausage making assembly line. The remaining components of the clipper device are fixed to the frame 10. Thus, a shoe 12 and cylinder assembly 14 are attached to the housing 10 by means of tie rods 16. Shoe 12 is attached to the lower side of housing 10. Assembly 14 is attached to the upper side.

Cylinder assembly 14 includes a pneumatically operated cylinder 18 having an attached cylinder cap 20. A piston 22 having an output shaft or rod 24 is retained within the pneumatic cylinder 18. Shaft or rod 24 provides the drive means for operation of the clipper device. Pneumatic controls for the cylinder assembly 14 are known to those skilled in the art. The piston 22 is shown in the retracted position in FIG. 5.

The rod or shaft 24 is attached at the end opposite piston 22 to a platen 26. Platen 26 extends laterally from both sides of the shaft 24. This is illustrated in FIG. 4. Drive rods 28 and 30 are fixed to each end of the platen 26. Drive rod 28 projects through bearing 32 in shoe 12. In a similar fashion, drive rod 30 projects through a bearing (not shown) in shoe 12. Thus, the drive rods 28 and 30 are slidable in the shoe 12 and move between a projected and retracted position in response to movement of platen 26 and piston 22.

First and second punches 34 and 36 are attached to a punch holder 38 which is in turn, affixed to the platen 26. Punches 34 and 36 project through guide slots 40 and 42 respectively in the shoe 12. The punches 34 and 36 have lower clip crim ends 44 and 46 respectively which have a rest or retracted position above rails 48 and 50 as shown in FIG. 5. Thus, clips 52, which are arranged on rails 48 and 50, are fed through a window 54 and 56 respectively in shoe 12 so that punches 34 and 36 respectively will engage a clip 52 and drive it downwardly in slots 40 and 42 respectively.

As shown in FIG. 4, one punch 34, is adjustable. That is a set screw 35 may be loosened and a wedge block 37 adjusted by set screws 39 and 41 to fix the distance the punch 34 extends into slot 40.

Rails 48 and 50 are supported respectively on rail support members 58 and 60 attached to shoe 12. The rails 48 and 50 provide a guide and support for clips 52 which are fed into the clipper device of the present invention.

The following description relates to the structure associated with punch 34. Similar structure is associated with punch 36.

Referring to FIG. 4, a die gate 62 and a gathering gate 64 are pivotally attached to show 12 by means of wrist pins 67 and 69 and mounting bolts 66 and 68 respectively. Gate 62 and gate 64 are attached to the shoe 12 on opposite sides of the path of travel for punch 34. A die block 70 is mounted in the die gate 62. Die gate 62 is comprised of a generally solid single plate member. Die gate 62 includes a projecting foot 63 which assists in the gathering of material positioned between the gates 62, 64 prior to clipping.

Gathering gate 64 is comprised of first and second parallel plate members 72 and 74 as shown in FIG. 3. Plates 72 and 74 are held in spaced relation by spacing gathering gate 64. Plates 72 and 74 are spaced to define a width sufficient for receipt of the plate defining die gate 62. Plates 72 and 74 each include a foot 65 to assist in gathering material between the gates 62, 64. Thus, gate 62 and gate 64 may be rotated from the unengaged position shown in FIG. 4 to the engaged or interlocked position illustrated by FIG. 8. Interlocking of the gates 62 and 64 is effected by pivotal rotation of the gate 62 and 64 in opposite rotational senses about the mounting wrist pins 67 and 69 respectively.

Die gate 62 includes a channel edge portion 78 which includes a slot or channel 75 defining the path of travel of one leg or side of a clip 52 driven by punch 34. Spacing member of gathering gate 64 includes a similar slot or channel 77 for receipt of the leg of a clip 52. Thus, when the gates 62 and 64 are pivoted to the position illustrated in FIG. 8, edges 78 and 80 define a channel 75, 77 for a clip 52 driven by punch 34. This channel terminates with die 70 which is provided to effect deformation and shaping of a clip 52 about material gathered gates 62 and 64.

The gates 62 and 64 are driven in their path of pivotal travel in response to downward translational movement of drive rods 28 and 30. That is, each drive rod 28 and 30 includes a projecting roller cam 82 and 84 respectively. Roller cams 82 and 84 respectively ride in camways 86 and 88 respectively defined in gates 64 and 62 respectively. Note that the camways 86 and 88 include an arcuate initial portion 86A and 88A respectively connected with a straight run portion 86B and 88B respectively. Consequently, as the drive rods 28 and 30 are driven downwardly in a straight line path, the gates 64 and 62 are pivoted toward one another.

The amount of pivotal movement by the gates 64 and 62 is limited and controlled by the arcuate camways 86A and 88A. The amount of rotation effected is the amount necessary to interlock the gates 64 and 62 in the position illustrated in FIG. 8, thereby defining a total channel for movement of a clip 52 into final engagement with die 70 in the path of punch 34.

The straight line segments 86B and 88B of the camways 86 and 88 are provided to permit continued translational movement of roller cams 82 and 84 subsequent to the pivotal motion by gates 64 and 62. In this manner, the platen and associated punch 34 continue the downward path of travel to effect clip 52 engagement with die 70. The roller cams 82 and 84 have the additional function of rigidly maintaining the gates 64 and 62 in a substantially interlocked, non-movable position during the final path of travel by the punch 34. The straight line segments or sections 86B and 88B of the camways 86 and 88 thus provide a lost motion function for the drive rods 28 and 30 during the actual clip attachment operation effected by punch 34.

It is noted that the camways 86 and 88 are closed camways having both sides available for cooperative action with roller cams 82 and 84. This ensures positive movement of the gates 64 and 62 when the drive rods 28 and 30 move in either translational direction, up or down.

While drive rods 28 and 30 slidably move through bearings in the shoe 12, beams 90 and 92 are fixed to shoe 12 and extend downwardly from the shoe 12 in the same direction as the path of travel effected by rods 28 and 30. The beams 90 and 92 are interconnected at their lower ends by a plate 94. Plate 94 includes keyed openings 96 and 98 which fit over beams 90 and 92 respectively. A threaded fastener 100 and 102 extends from each beam and cooperates with a threaded knob 104 and 106 to hold the plate 94 on the beams 90, 92.

Additional means for maintaining gate 62 as well as gate 64 in locked position when the punch 34 is in the extended or die engaging position includes a guide block as at 112 in FIG. 7 which engages the shaft 30 or drive rod 30. This prevents the rod 30 from lateral bending due to the force imparted on the shaft by the punch 34 engaging the die 70. A guide or support block such as block 112 may be provided for cooperation with either drive shaft or drive rod 28 or 30.

The plate 94 also serves as the mounting bracket for a knife holder 114. That is, knife holder 114 constitutes an enlonaged member pivotally mounted by means of mounting bolt 116 to plate 94. Knife holder 114 includes a blade 118 at one end. The opposite end of holder 114 is pivotally connected with a rod 120 driven by a cylinder 122 which effects cutting movement of blade 118. For example, subsequent to attachment of a clip 52 to some material gathered between gates 62 and 64, cylinder 122 causes the knife holder 114 to pivot the blade 118 and cut the gathered material adjacent the attached clip 52.

In addition to gathering material by means of gates 62 and 64, a supplemental gathering bar 124 is provided. Gathering bar 124 is an elongated U-shaped bar member pivotally connected at its opposite ends to gates 62 and 64 respectively. The gathering bar 124 includes a horizontal slot 126 and 128 at each end through which a mounting bolt 130 and 132 respectively is slidably projected. Bolts 130 and 132 are attached to gates 62 and 64 respectively. As gates 62 and 64 rotate toward one another, the bolts 130 and 132 are carried about the pivot axes defined by pivot bolts 66 and 68 to location indicated in FIG. 8. Consequently, the bolts 130 and 132 carry the gathering bar 124 downwardly toward the die 70.

To accommodate the apparent movement of bolts 130 and 132 in a horizontal direction as they simultaneously move vertically downward with the rotation of gates 62 and 64, the slots 126 and 128 are provided. Consequently, the bolts 130 and 132 move from the outside edges of slots 126 and 128 as shown in FIG. 4 to the inside edges of said slots 126 and 128 as shown in FIG. 8 as the gates 62 and 64 move from the open to the closed position.

Thus, as the single piston 22 moves from the retracted to the projected position, the gates 62 and 64 simultaneously close thereby gathering material therebetween. Simultaneously, the gathering bar 124 moves downward and further gathers material prior to attachment of a clip 52. Gate 62, 64 pivoted movement as well as the movement of the gathering bar 124 is totally effected by drive rods 28, 30 cooperating with the arcuate cam paths 86A and 88A.

Subsequently, the continued operation of the single piston 22 towards the projected position causes the punch 34 to move a clip 52 down the channel 40 defined in the shoe 12, into chanel 75, 77 defined by the gates 62 and 64 and into engagement with die 70. The clip 52 is thus fastened about the gathered material. The knife blade 118 is then moved across the now-clipped end of the gathered material as shown in FIG. 8. The piston 22 is retraced thereby releasing the clipped end of the casing and making the device available for continued cycles.

In the embodiment disclosed, two punches 34, 36 are simultaneously driven so that two clips 52 may be simultaneously attached by the clipper device. Thus, two sets of gates as well as two gathering bars are simultaneously driven by the single piston 22. In this manner, the clipper device of the present invention may be positioned adjacent the discharge nozzle of a sausage machine. As shirred material is fed from the discharge nozzle of the sausage machine and the sausage casing is thus filled, the filled casing passes between two pair of adjacent, open gates 62 and 64 of the clipper device. Once a sufficient length of casing is filled, the clipper is actuated to gather the casing material and subsequently clip the end of the filled casing. Simultaneously an adjacent clip is attached to the end of the casing yet to be filled. The knife blade 118 then operates to separate the filled casing from the unfilled casing. the operation can then be repeated.

Attachment of both clips and gathering of all the casing material is effected by a single piston. Sequencing of operations is provided by the mechanical interconnection between the gathering gates 62, 64 and the punches 34, 36 which drives the clips 52. Thus, while there has been described a preferred embodiment of the present invention, it is to be understood that the invention shall be limited only by the following claims and their equivalents.

What is claimed is:

1. An improved clip attachment device comprising, in combination:

a mounting frame;

drive means mounted on the mounting frame, said drive means having a unitary drive shaft translatable between a projected position and a retracted position;

a punch for driving a clip, said punch attached to said drive shaft and translatable thereby between a retracted position and a projected clip fastening position;

clip ejection means for positioning a clip in the path of the punch means intermediate the retracted position and clip fastening position;

first and second gates pivotally attached to the mounting frame in opposed relation on opposite sides of the path of travel of the punch, one of said gates including a die for cooperation with said punch, said gates being pivotal between a closed position for clip attachment and an open position for release of clip material; and first and second parallel linkage arms, each arm being attached to said drive shaft for movement parallel with the punch on opposite sides thereof, said first arm including cam drive means cooperative with the first gate to pivotably drive said gate from the open position to the closed position, the second arm including cam drive means cooperative with the second gate to pivotally drive said second gate from the open position to the closed position, said die being cooperative with the punch when the gates are both in the closed position to form a clip about material positioned and gathered by action of closing said gates.

2. The improved device of claim 1 wherein said gates each include a separate camway cooperative with followers attached to the associated linkage member, said camway and linkage member cooperative to initially pivot the gate members from the open to the closed position upon downward travel of the linkage arms to effect closing of the gate members pivot to travel of the punch and clip toward complete engagement with the die, said camway including a section parallel with the direction of travel of the linkage arm when the gates are in the closed position to thereby effect retention of the gate members in a non-rotatable position upon the closing of the gate members by the partial travel of said linkage arms from the retracted toward the projected position.

3. The improved device of claim 1 including a gathering bar pivotally attached at its opposite ends to each separate gate member and translatable in the direction of punch travel upon the rotation of said gate members toward the closed position.

4. The improved device of claim 3 wherein said gathering bar includes a camway at its opposite ends cooperative with a guide pin on the first and second gates respectively, said guide pin being moved in the direction of punch travel upon closing of said gates and imparting said movement in that direction to the gathering bar.

5. The improved device of claim 1 including a plurality of punches attached to the drive shaft with a first and second gates associated with each separate punch all driven by the same drive means.

6. The improved device of claim 1 including detent means for holding said die gate in the closed position.

7. The improved device of claim 1 including means for adjusting the distance of travel of said punch.

8. The improved device of claim 1 including means engaging at least one of said linkage arms against lateral movement thereof when said linkage arms are in the projected position.

9. The improved device of claim 1 wherein each of said gates include flanges for gathering material interposed between said gates prior to attachment of a clip said material.

10. The improved device of claim 1 wherein said drive means comprise a pneumatically driven piston having a rod for the drive shaft.

11. The improved device of claim 1 wherein said linkage arms are equidistantly spaced on opposite sides of the punch and retained thereby by a platen, said platen driven by the drive shaft.

12. The improved device of claim 1 wherein said gates includes opposed slots defining, in part, the clip channel when the gates are pivoted to the closed position.

* * * * *

UNITED STATES PATENT OFFICE

CERTIFICATE OF CORRECTION

Patent No. 4,001,926 Dated January 11, 1977

Inventor(s) Clyde R. Velarde

It is certified that error appears in the above-identified patent and that said Letters Patent are hereby corrected as shown below:

Claim 2, line 23, "pivot" is corrected to --prior--.

Signed and Sealed this

*Fourth* Day of *December 1979*

[SEAL]

*Attest:*

SIDNEY A. DIAMOND

*Attesting Officer*

*Commissioner of Patents and Trademarks*